US008870409B2

(12) United States Patent
Ye et al.

(10) Patent No.: US 8,870,409 B2
(45) Date of Patent: Oct. 28, 2014

(54) LIGHT TUBE

(71) Applicants: Dongguan Masstop Liquid Crystal Display Co., Ltd., Dongguan (CN); Wintek Corporation, Taichung (TW)

(72) Inventors: Zhi-Ting Ye, Miaoli County (TW); Ming-Chuan Lin, Taichung (TW); Hung-Pin Chang, Taichung (TW); Wen-Chieh Wu, New Taipei (TW)

(73) Assignees: Dongguan Masstop Liquid Crystal Display Co., Ltd., Industrial Road, Dongcheng, Dongguan, Guangdong (TW); Wintek Corporation, Taichung (TW)

( * ) Notice: Subject to any disclaimer, the term of this patent is extended or adjusted under 35 U.S.C. 154(b) by 84 days.

(21) Appl. No.: 13/864,276

(22) Filed: Apr. 17, 2013

(65) Prior Publication Data

US 2014/0160743 A1 Jun. 12, 2014

(30) Foreign Application Priority Data

Dec. 7, 2012 (TW) ..... 101223833 U

(51) Int. Cl.

| | |
|---|---|
| ***F21V 5/02*** | (2006.01) |
| ***F21K 99/00*** | (2010.01) |
| ***F21V 5/00*** | (2006.01) |
| *F21Y 101/02* | (2006.01) |
| *F21Y 103/00* | (2006.01) |
| *F21V 3/04* | (2006.01) |

(52) U.S. Cl.

CPC ..... *F21K 9/50* (2013.01); *F21Y 2101/02* (2013.01); *F21K 9/17* (2013.01); *F21Y 2103/003* (2013.01); *F21V 3/049* (2013.01); *F21V 5/002* (2013.01)

USPC ..... 362/223; 362/217.02; 362/332; 362/337; 362/338

(58) Field of Classification Search

CPC ..... F21V 5/002; F21V 5/004; F21V 5/005; F21V 5/008; F21V 5/02; F21V 5/04; F21K 9/00; F21K 9/30; F21K 9/50; F21K 9/52; F21Y 2101/02; F21Y 2103/00

USPC ..... 362/217.01, 217.02, 223, 224, 311.02, 362/335–340

See application file for complete search history.

(56) References Cited

U.S. PATENT DOCUMENTS

| | | | | |
|---|---|---|---|---|
| 8,038,322 | B2 * | 10/2011 | Chen | 362/249.02 |
| 8,454,206 | B2 * | 6/2013 | Chang | 362/339 |
| 2011/0175536 | A1 * | 7/2011 | Fujita et al. | 315/185 R |
| 2013/0128577 | A1 * | 5/2013 | Wang He | 362/237 |

* cited by examiner

*Primary Examiner* — Thomas M Sember

(74) *Attorney, Agent, or Firm* — Winston Hsu; Scott Margo

(57) ABSTRACT

A light tube includes a tube body, at least one light emitting diode, and a transparent cover. The light emitting diode is assembled with the tube body. The transparent cover is disposed on the tube body to cover the light emitting diode and has a roof portion and two side arm portions. A first microstructure region and a second microstructure region are formed on a surface of the roof portion corresponding to the light emitting diode. The second microstructure region extends from two ends of the first microstructure region. A third microstructure region is formed on a surface of each side arm portion corresponding to the light emitting diode. A microstructure density of the second microstructure region is less than or equal to a microstructure density of the first microstructure region, and is greater than or equal to a microstructure density of the third microstructure region.

14 Claims, 3 Drawing Sheets

LIGHT TUBE

BACKGROUND OF THE INVENTION

1. Field of the Invention

The present invention relates to a light tube, and more specifically, to a light tube having microstructure regions respectively formed on a roof portion and two side arm portions of a transparent cover.

2. Description of the Prior Art

In recent years, for achieving the environmental protection and energy saving purposes, a cold cathode fluorescent lamp has gradually been replaced by a light emitting diode tube utilizing at least one light emitting diode as a light source. However, the light emitting diode tube only has an illumination angle of about 120° due to the limited light emitting angle of the light emitting diode (about 120°), which is far less than that of the cold cathode fluorescent lamp, so as to restrict the illumination application of the light emitting diode tube.

In the prior art, the design of utilizing an approximately planar cover to replace a semi-circular cover for providing approximately planar illumination has been developed to increase the light emitting angle of the light emitting diode tube. However, due to uneven brightness distribution on the approximately planar cover caused by different light paths from the light emitting diode to the approximately planar cover when light emitted by the light emitting diode is incident into the approximately planar cover, the aforesaid design usually makes the light emitting diode tube have a poor visual effect.

SUMMARY OF THE INVENTION

The present invention provides a light tube including a tube body, at least one light emitting diode, and a transparent cover. The light emitting diode is assembled with the tube body. The transparent cover is disposed on the tube body to cover the light emitting diode and has a roof portion and two side arm portions. A first microstructure region and a second microstructure region are formed on a surface of the roof portion corresponding to the light emitting diode. The second microstructure region extends from two ends of the first microstructure region. A third microstructure region is formed on a surface of each side arm portion corresponding to the light emitting diode. A microstructure density of the second microstructure region is less than or equal to a microstructure density of the first microstructure region and is greater than or equal to a microstructure density of the third microstructure region.

The present invention further provides alight tube including a tube body, at least one light emitting diode, and a transparent cover. The light emitting diode is assembled with the tube body. The transparent cover is disposed on the tube body to cover the light emitting diode and has a roof portion and two side arm portions. A first microstructure region and a second microstructure region are formed on a surface of the roof portion corresponding to the light emitting diode. The second microstructure region extends from two ends of the first microstructure region. A third microstructure region is formed on a surface of each side arm portion corresponding to the light emitting diode. A microstructure density of the second microstructure region is less than a microstructure density of the first microstructure region and is greater than a microstructure density of the third microstructure region.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
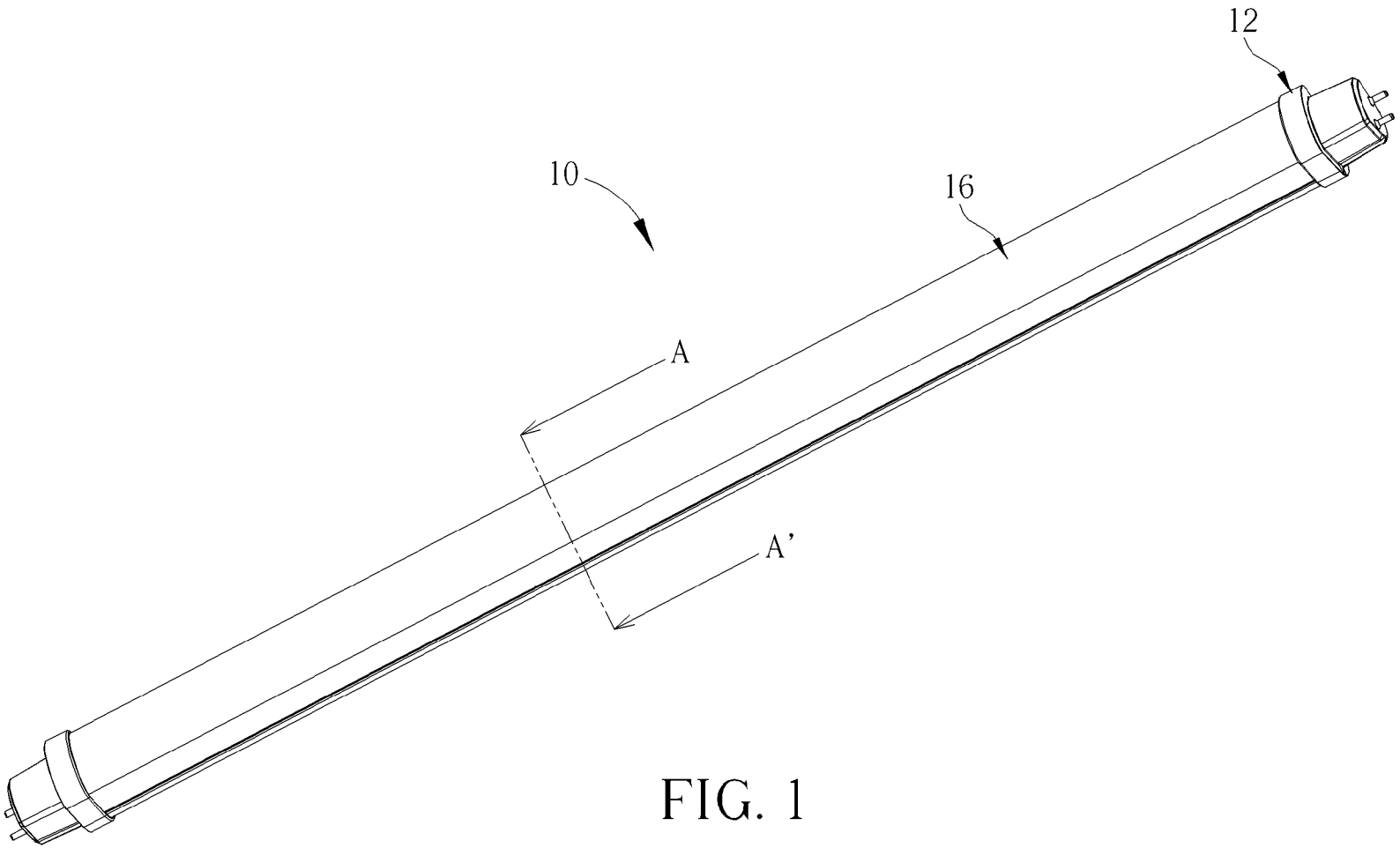
FIG. 1 is a diagram of a light tube according to an embodiment of the present invention.
Figure 2:
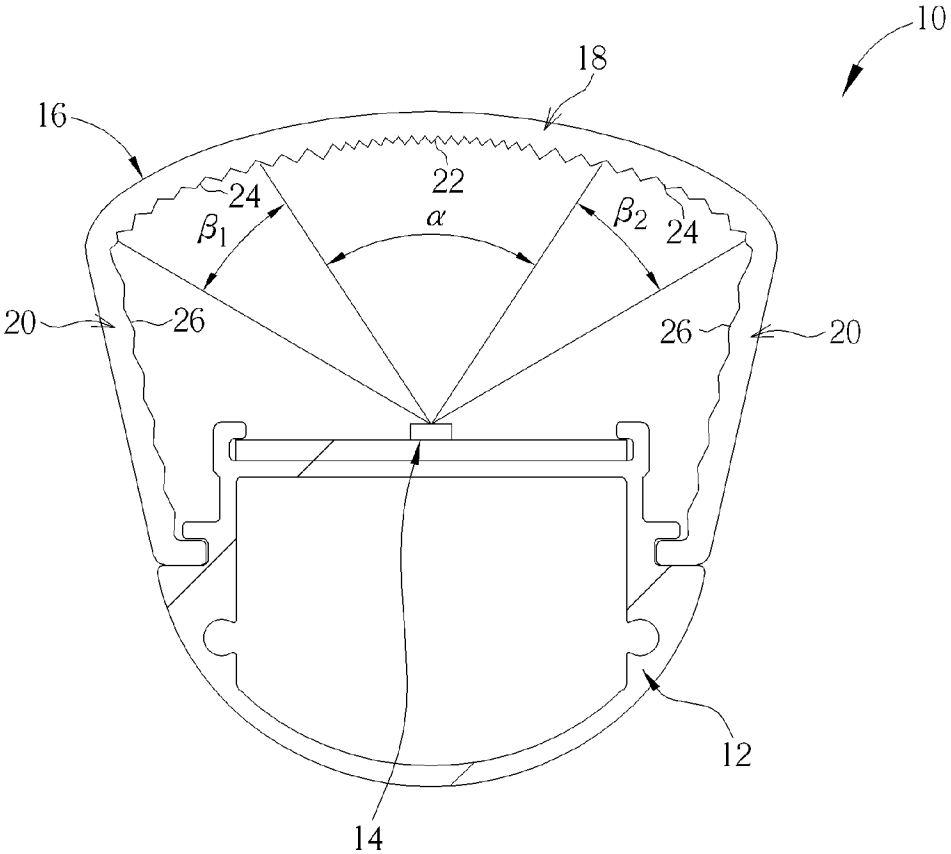
FIG. 2 is a cross-sectional diagram of the light tube in FIG. 1 along a sectional line A-A'.

Please refer to FIG. 1 and FIG. 2. FIG. 1 is a diagram of a light tube 10 according to an embodiment of the present invention. FIG. 2 is a cross-sectional diagram of the light tube 10 in FIG. 1 along a sectional line A-A'. As shown in FIG. 1 and FIG. 2, the light tube 10 includes a tube body 12, at least one light emitting diode 14 (one shown in FIG. 2, but not limited thereto), and a transparent cover 16. The tube body 12 includes other tube components (e.g. a heat dissipating structure and a lamp plug) of a common light emitting diode tube besides a light emitting diode and a transparent cover. The light emitting diode 14 can be assembled with the tube body 12 and used as a light source for emitting sufficient light to the transparent cover 16. As for the related description for the components of the tube body 12 and the electrical connection and trace designs between the light emitting diode 14 and the tube body 12, it is commonly seen in the prior art and therefore omitted herein.

Figure 3:
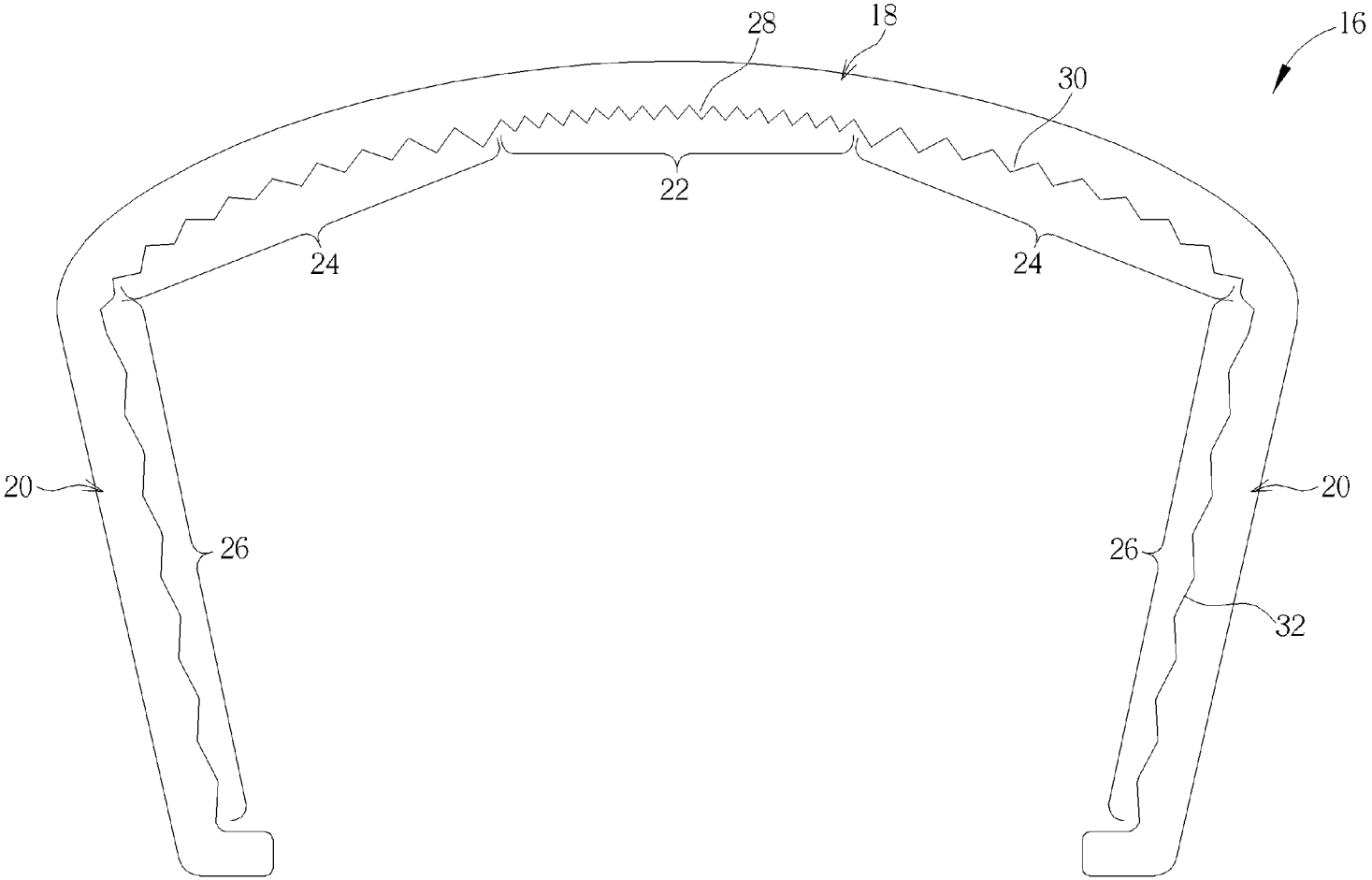
FIG. 3 is an enlarged diagram of a transparent cover in FIG. 2.

More detailed description for the structural design of the transparent cover 16 is provided as follows. Please refer to FIG. 2 and FIG. 3. FIG. 3 is an enlarged diagram of the transparent cover 16 in FIG. 2. As shown in FIG. 2 and FIG. 3, the transparent cover 16 is disposed on the tube body 12 to cover the light emitting diode 14. The transparent cover 16 is preferably made of light scattering material with a haze greater than 70% (but not limited thereto) for further enhancing its light scattering effect, so as to make light passing through the transparent cover 16 have a more uniform brightness distribution.

As shown in FIG. 3, the transparent cover 16 has a roof portion 18 and two side arm portions 20 to cooperatively form a U-shaped cover structure. The roof portion 18 could be an arc-shaped structure, a radius of which falls within a range between 1 μm and 1000 μm, for providing approximately planar illumination when light is incident into the roof portion 18, but not limited thereto. That is, in another embodiment, the roof portion 18 could be a planar structure. As for which structural design is utilized, it depends on the practical illumination application of the light tube 10. A first microstructure region 22 and a second microstructure region 24 are formed on a surface of the roof portion 18 corresponding to the light emitting diode 14. More specified, said surface of the roof portion 18 faces the light emitting diode 14. The second microstructure region 24 extends from two ends of the first microstructure region 22. Each side arm portion 20 could be a planar structure, and a third microstructure region 26 is formed on a surface of each side arm portion 20 corresponding to the light emitting diode 14. More specified, said surface of the side arm portion 20 faces the light emitting diode 14. A microstructure density of the first microstructure region 22 could be greater than or equal to a microstructure density of the second microstructure region 24, and the microstructure density of the second microstructure region 24 could be greater than or equal to a microstructure density of the third microstructure region 26. To be more specific, in this embodiment, the microstructure density of the first microstructure region 22 is preferably greater than the microstructure density of the second microstructure region 24, and the microstructure density of the second microstructure region 24 is preferably greater than the microstructure density of the third microstructure region 26. That is, the aforesaid microstructures are sequentially formed on the transparent cover 16 from the roof portion 18 to the side arm portion 20 in a from-dense-to-sparse manner.

In practical application, a central angle $\alpha$ of the first microstructure region 22 relative to the light emitting diode 14 is preferably less than or equal to 40°. A sum of central angles $\beta_1$, $\beta_2$ of two sections of the second microstructure region 24 respectively extending from two ends of the first microstructure region 22 preferably falls within a range between 41° and 80° but not limited thereto. In other words, the aforesaid central angles of the first microstructure region 22 and the second microstructure region 24 relative to the light emitting diode 14 are adjustable according to the practical illumination application of the light tube 10.

In this embodiment, the transparent cover 16 could have sawtooth-shaped bar microstructures formed thereon for further enhancing the light scattering effect of the transparent cover 16. For example, as shown in FIG. 3, the first microstructure region 22 could include a plurality of first sawtooth-shaped bar structures 28, the second microstructure region 24 could include a plurality of second sawtooth-shaped bar structures 30, and the third microstructure region 26 could include a plurality of third sawtooth-shaped bar structures 32. A vertex angle of each first sawtooth-shaped bar structure 28 preferably falls within a range between 70° and 90°. A vertex angle of each second sawtooth-shaped bar structure 30 preferably falls within a range between 90° and 120°. A vertex angle of each third sawtooth-shaped bar structure 32 preferably falls within a range between 120° and 150°.

Via the design in which the aforesaid microstructures are distributed sequentially from the roof portion 18 to the side arm portions 20 in a from-dense-to-sparse manner with the gradually-increasing vertex angles, the light scattering effect of the transparent cover 16 could be further enhanced after light emitted by the light emitting diode 14 is incident into the first microstructure region 22, the second microstructure region 24, and the third microstructure region 26. Accordingly, the light emitting angle of the light tube 10 could be increased and light emitted out of the transparent cover 16 could have a more uniform brightness distribution.

It should be mentioned that the microstructure design of the transparent cover 16 is not limited to the aforesaid embodiment. In other words, all microstructure designs for light scattering enhancement could be utilized by the present invention. For example, in another embodiment, the first, second, and third microstructure regions 22, 24, 26 could have a plurality of first, second, and third arc-shaped bar structures respectively. A radius of each second arc-shaped bar structure is preferably less than or equal to a radius of each first arc-shaped bar structure and is preferably greater than a radius of each third arc-shaped bar structure. That is, the aforesaid arc-shaped bar structures are distributed sequentially from the roof portion 18 to the side arm portions 20 of the transparent cover 16 with the gradually-decreasing radiuses. As for other related description, it could be reasoned according to the aforesaid embodiment and therefore omitted herein. To be noted, the present invention could also utilize the design in which the microstructures of different shapes (e.g. the tooth-shaped bar structures and the arc-shaped bar structures) are formed on different microstructure regions respectively or one microstructure region, to improve flexibility of the transparent cover 16 in its structural design.

In summary, the present invention utilizes the structural designs of the roof portion and the side arm portion of the transparent cover and the design in which the microstructures are distributed sequentially from the roof portion to the side arm portions in a from-dense-to-sparse manner, to make the transparent cover capable of providing approximately planar illumination and having a light scattering enhancement effect, so that the light emitting angle of the light tube could be increased and light emitted out of the transparent cover could have a more uniform brightness distribution. In such a manner, the light tube provided by the present invention could not only have a planar illumination function (or an approximately illumination function), but also solve the prior art problem that a light tube has a poor visual effect due to uneven brightness distribution on an approximately planar cover. Accordingly, the illumination quality of the light tube provided by the present invention could be greatly improved.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A light tube comprising:

a tube body;

at least one light emitting diode assembled with the tube body; and a transparent cover disposed on the tube body to cover the light emitting diode and having a roof portion and two side arm portions, a first microstructure region and a second microstructure region being formed on a surface of the roof portion corresponding to the light emitting diode, the second microstructure region extending from two ends of the first microstructure region, a third microstructure region being formed on a surface of each side arm portion corresponding to the light emitting diode, a microstructure density of the second microstructure region being less than or equal to a microstructure density of the first microstructure region and being greater than or equal to a microstructure density of the third microstructure region.

2. The light tube of claim 1, wherein a central angle of the first microstructure region relative to the light emitting diode is less than or equal to 40°.

3. The light tube of claim 2, wherein a sum of central angles of two sections of the second microstructure region respectively extending from two ends of the first microstructure region falls within a range between 41° and 80°.

4. The light tube of claim 1, wherein the first microstructure region has a plurality of first sawtooth-shaped bar structures, the second microstructure region has a plurality of second sawtooth-shaped bar structures, and the third microstructure region has a plurality of third sawtooth-shaped bar structures.

5. The light tube of claim 4, wherein a vertex angle of each first sawtooth-shaped bar structure falls within a range between 70° and 90° a vertex angle of each second sawtooth-shaped bar structure falls within a range between 90° and 120° and a vertex angle of each third sawtooth-shaped bar structure falls within a range between 120° and 150°.

6. The light tube of claim 1, wherein the first microstructure region has a plurality of first arc-shaped bar structures, the second microstructure region has a plurality of second arc-shaped bar structures, and the third microstructure region has a plurality of third arc-shaped bar structures, a radius of each second arc-shaped bar structure is less than or equal to a radius of each first arc-shaped bar structure, and a radius of each third arc-shaped bar structure is less than or equal to the radius of each second arc-shaped bar structure.

7. The light tube of claim 1, wherein the roof portion is an arc-shaped structure, and a radius of the roof portion falls within a range between 1 μm and 1000μ.

8. The light tube of claim 1, wherein the roof portion is a planar structure.

9. The light tube of claim 1, wherein the transparent cover is made of light scattering material with a haze greater than 70%.

10. A light tube comprising:

a tube body;

at least one light emitting diode assembled with the tube body; and a transparent cover disposed on the tube body to cover the light emitting diode and having a roof portion and two side arm portions, a first microstructure region and a second microstructure region being formed on a surface of the roof portion corresponding to the light emitting diode, the second microstructure region extending from two ends of the first microstructure region, a third microstructure region being formed on a surface of each side arm portion corresponding to the light emitting diode, a microstructure density of the second microstructure region being less than a microstructure density of the first microstructure region and being greater than a microstructure density of the third microstructure region.

11. The light tube of claim 10, wherein the first microstructure region has a plurality of first sawtooth-shaped bar structures, the second microstructure region has a plurality of second sawtooth-shaped bar structures, and the third microstructure region has a plurality of third sawtooth-shaped bar structures.

12. The light tube of claim 11, wherein a vertex angle of each first sawtooth-shaped bar structure falls within a range between 70° and 90° a vertex angle of each second sawtooth-shaped bar structure falls within a range between 90° and 120° and a vertex angle of each third sawtooth-shaped bar structure falls within a range between 120° and 150°.

13. The light tube of claim 10, wherein the roof portion is an arc-shaped structure, and a radius of the roof portion falls within a range between 1 μm and 1000 μm.

14. The light tube of claim 10, wherein the roof portion is a planar structure.

* * * * *